US008265332B2

(12) United States Patent
Kumakura et al.

(10) Patent No.: US 8,265,332 B2
(45) Date of Patent: Sep. 11, 2012

(54) SPEAKER DIAPHRAGM AND SPEAKER

(75) Inventors: Hiroyuki Kumakura, Hachiouji (JP); Koji Yamazawa, Hachiouji (JP)

(73) Assignee: J&K Car Electronics Corporation, Tokyo-To (JP)

( * ) Notice: Subject to any disclaimer, the term of this patent is extended or adjusted under 35 U.S.C. 154(b) by 147 days.

(21) Appl. No.: 12/927,953

(22) Filed: Nov. 30, 2010

(65) Prior Publication Data

US 2011/0129113 A1 Jun. 2, 2011

(30) Foreign Application Priority Data

Dec. 2, 2009 (JP) ..... 2009-274894
Sep. 10, 2010 (JP) ..... 2010-203008

(51) Int. Cl.
*H04R 25/00* (2006.01)

(52) U.S. Cl. ..... 381/423; 381/424; 381/432

(58) Field of Classification Search ..... 381/398, 381/423, 424, 425, 426, 430, 432; 181/157, 181/163, 164, 165, 171, 172
See application file for complete search history.

(56) References Cited

U.S. PATENT DOCUMENTS

| | | | | |
|---|---|---|---|---|
| 1,870,417 | A * | 8/1932 | Mallina | 181/170 |
| 6,026,929 | A * | 2/2000 | Faraone | 181/173 |
| 8,199,962 | B2 * | 6/2012 | Maeda | 381/398 |

FOREIGN PATENT DOCUMENTS

| | | |
|---|---|---|
| JP | 2005-303911 | 10/2005 |
| JP | 2007-028523 | 2/2007 |
| WO | WO 2005/029917 | 3/2005 |

* cited by examiner

*Primary Examiner* — Huyen D Le
(74) *Attorney, Agent, or Firm* — Renner, Kenner, Greive, Bobak, Taylor & Weber

(57) ABSTRACT

A speaker diaphragm with a circular opening in a center zone thereof has a pattern of concave and convex sections formed on a front surface or a rear surface thereof. A plurality of concave and convex sections are formed in each of regions provided at a regular interval with a specific angle in a circumferential direction of the diaphragm. The concave and convex sections formed in each region have different sizes in a radial direction of the diaphragm. The concave and convex sections formed in adjacent regions are displaced from each other in the radial direction. The concave and convex sections formed on the diaphragm are aligned on at least a first and a second imaginary curved line, respectively, each imaginary curved line passing regions and approaching an inner periphery of the circular opening from an outer periphery of the diaphragm.

14 Claims, 5 Drawing Sheets

SPEAKER DIAPHRAGM AND SPEAKER

CROSS-REFERENCE TO RELATED APPLICATIONS

This application is based on and claims the benefit of priority from the prior Japanese Patent Application Nos. 2009-274894 filed on Dec. 2, 2009, and 2010-203008 filed on Sep. 10, 2010, the entire contents of which is incorporated herein by reference.

BACKGROUND OF THE INVENTION

The present invention relates to a speaker diaphragm and a speaker.

The sounds output from a speaker involve sounds corresponding to original sounds that should be reproduced and incidental sounds that are extra sounds other than the original sounds.

The incidental sounds output from a speaker are generated by the resonance of a speaker diaphragm (also referred to as a diaphragm, hereinafter), for example. The utmost reduction of incidental sounds effectively improves the quality of sounds output from a speaker.

One technique to reduce incidental sounds is dispersion of the resonance frequency with improvements in the structure of a diaphragm, for example, provision of concavities and convexities in a grid pattern on a diaphragm manufactured with a woven cloth.

There is, however, a demand for a speaker diaphragm that can disperse the resonance frequency more effectively to reduce incidental sounds output from a speaker.

SUMMARY OF THE INVENTION

A purpose of the present invention is to provide a speaker diaphragm with an improved structure for effectively dispersing the resonance frequency to drastically reduce incidental sounds and a speaker equipped with such a speaker diaphragm.

The present invention provides a speaker diaphragm having a circular opening in a center zone thereof comprising: a concave and convex pattern of a plurality of concave sections and convex sections formed on a front surface or a rear surface of the diaphragm; wherein the concave and convex pattern is formed in a manner that; a plurality of concave sections and convex sections are formed in each of a plurality of regions provided at a regular interval with a specific angle in a circumferential direction of the diaphragm, the concave and convex sections formed in each region have different sizes in a radial direction of the diaphragm, a plurality of concave and convex sections formed in adjacent regions are displaced from each other in the radial direction, and the concave sections and the convex sections formed on the diaphragm are aligned on at least a first imaginary curved line and at least a second imaginary curved line, respectively, each imaginary curved line passing a plurality of regions and approaching an inner periphery of the circular opening from an outer periphery of the diaphragm.

Moreover, the present invention provides a speaker comprising: a diaphragm having a circular opening in a center zone thereof; and a voice coil for vibrating the diaphragm in both directions of the front and rear surfaces in response to a current corresponding to an audio signal, wherein the diaphragm has a concave and convex pattern of a plurality of concave sections and convex sections formed on a front surface or a rear surface of the diaphragm, the concave and convex pattern being formed in a manner that; a plurality of concave sections and convex sections are formed in each of a plurality of regions provided at a regular interval with a specific angle in a circumferential direction of the diaphragm, the concave and convex sections formed in each region have different sizes in a radial direction of the diaphragm, a plurality of concave and convex sections formed in adjacent regions are displaced from each other in the radial direction, and the concave sections and the convex sections formed on the diaphragm are aligned on at least a first imaginary curved line and at least a second imaginary curved line, respectively, each imaginary curved line passing a plurality of regions and approaching an inner periphery of the circular opening from an outer periphery of the diaphragm.

Furthermore, the present invention provides a speaker diaphragm comprising: a front surface and a rear surface; a circular opening provided in a center zone of the diaphragm and passing through the front and rear surfaces; a pattern area that is wider than and covers the center zone, the pattern area being provided on at least either the front or the rear surface and being segmented into a plurality of regions at a regular interval with a specific angle in a circumferential direction with respect to the center zone, the regions being provided between an outer periphery of the pattern area and an inner periphery of the circular opening; and a pattern of concave sections and convex sections formed in the pattern area, wherein a plurality of concave sections and convex sections are formed alternately in each region of the pattern area, all of the concave and convex sections in each region having different sizes in a radial direction with respect to the center zone when viewed from above the diaphragm, a plurality of concave sections formed in a first region among the plurality of regions and a plurality of concave sections formed in a second region among the plurality of regions and next to the first region are partially displaced from each other in the radial direction, a plurality of convex sections formed in the first region and a plurality of convex sections formed in the second region are partially displaced from each other in the radial direction, and all of the concave sections and the convex sections of the pattern are aligned on at least a first imaginary curved line and a second imaginary curved line, respectively, each imaginary curved line passing the plurality of regions and approaching the inner periphery of the circular opening from the outer periphery of the pattern area.

Still, furthermore, the present invention provides a speaker comprising: a diaphragm having a front surface and a rear surface, and a circular opening provided in a center zone of the diaphragm and passing through the front and rear surfaces; and a voice coil for vibrating the diaphragm in both directions of the front and rear surfaces in response to a current corresponding to an audio signal, wherein the diaphragm includes: a pattern area that is wider than and covers the center zone, the pattern area being provided on at least either the front or the rear surface and being segmented into a plurality of regions at a regular interval with a specific angle in a circumferential direction with respect to the center zone, the regions being provided between an outer periphery of the pattern area and an inner periphery of the circular opening; and a pattern of concave sections and convex sections formed in the pattern area, wherein a plurality of concave sections and convex sections are formed alternately in each region of the pattern area, all of the concave and convex sections in each region having different sizes in a radial direction with respect to the center zone when viewed from above the diaphragm, a plurality of concave sections formed in a first region among the plurality of regions and a plurality of concave sections formed in a second region among the plurality of regions and next to the first region are partially displaced from each other in the radial direction, a plurality of convex sections formed in the first region and a plurality of convex sections formed in the second region are partially displaced from each other in the radial direction, and all of the concave sections and the convex sections of the pattern are aligned on at least a first imaginary curved line and a second imaginary curved line, respectively, each imaginary curved line passing the plurality of regions and approaching the inner periphery of the circular opening from the outer periphery of the pattern area.

BRIEF DESCRIPTION OF DRAWINGS

FIG. 1 is a sectional view of an embodiment of the

DETAILED DESCRIPTION OF PREFERRED EMBODIMENTS

Preferred embodiments of a speaker diaphragm and a speaker according to the present invention will be described with respect to the attached drawings.

Figure 1:
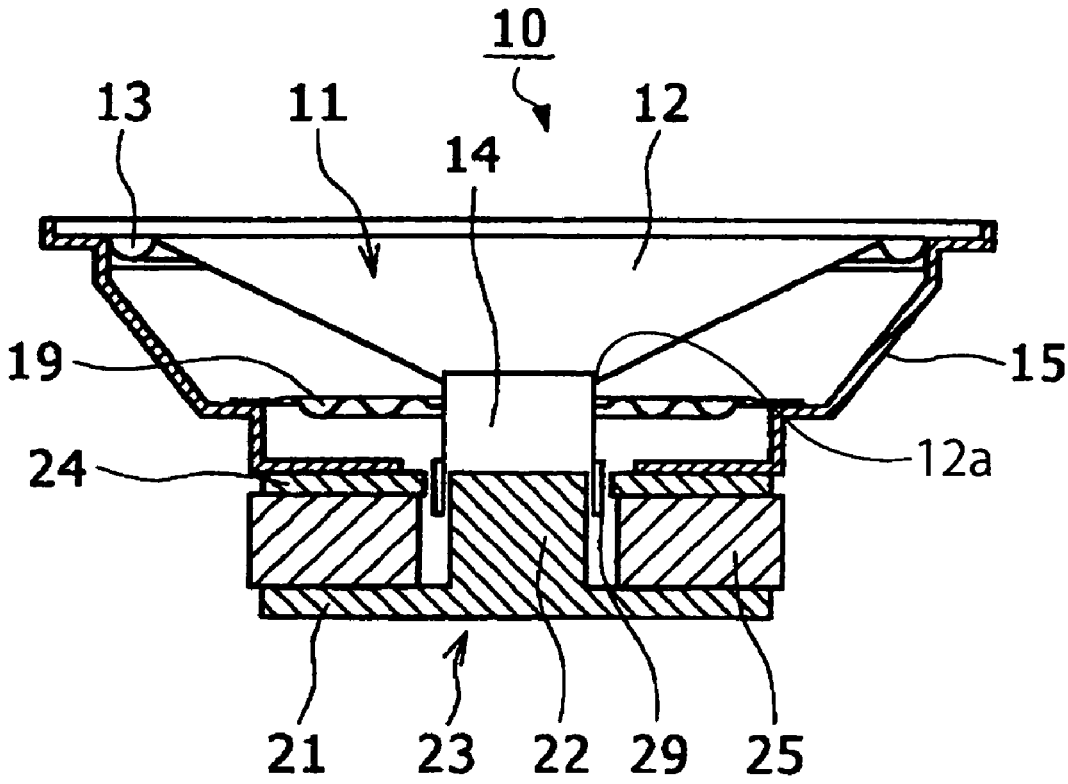

FIG. 1 is a sectional view of a speaker 10, an embodiment of the speaker according to the present invention. The front side of the speaker 10 is shown in the upper side of FIG. 1.

In FIG. 1, the speaker 10 is equipped with a speaker diaphragm 11. The diaphragm 11 has a cone diaphragm portion 12 and an annular edge 13 formed around the outer circumference of the diaphragm portion 12. A circular opening 12*a* is provided at the center of the diaphragm portion 12. Fit in the opening 12 is the top pf a cylindrical member 14. Although not shown in FIG. 1, the opening 12*a* is covered with a dome cap. The diaphragm 11 is surrounded by a frame 15, with the outer circumference of the edge 13 fixed to the front end of the frame 15.

The speaker 10 is further equipped with a corrugated damper 19, having first and second ends, for dampening the vibration of the diaphragm 11. The damper 19 is connected to the outer periphery of the cylindrical member 14 at the first end and to the inner periphery of the rear end of the frame 15 at the second end.

A yoke 23 is provided at the rear side of the speaker 10, having a disc portion 21 and a boss portion 22 that protrudes towards the front side of the speaker 10 from the center of the disc portion 21. The top of the boss portion 22 is inserted into the cylindrical member 14.

An annular plate 24 is provided closer than the disc portion 21 to the front side of the speaker 10 to face the disc portion 21. A ring magnet 25 is provided between the disc portion 21 and the annular plate 24.

A voice coil 29 is wound around the cylindrical member 14 at the lower end (the bottom) of the member 14 that is closer to the rear side of the speaker 10.

There are annular gaps between the inner periphery of the annular plate 24 and the voice coil 29, and between the inner periphery of the cylindrical member 14 and the outer periphery of the boss portion 22.

A magnetic field is generated in the annular gaps when a current corresponding to an audio signal is supplied to the voice coil 29. Specifically, when the current is supplied, a magnetic force is applied to the voice coil 29 in both of the directions to the front and rear sides of the speaker 10 to vibrate the diaphragm portion 12 in both of the directions, thus the speaker generates sounds.

Figure 2:
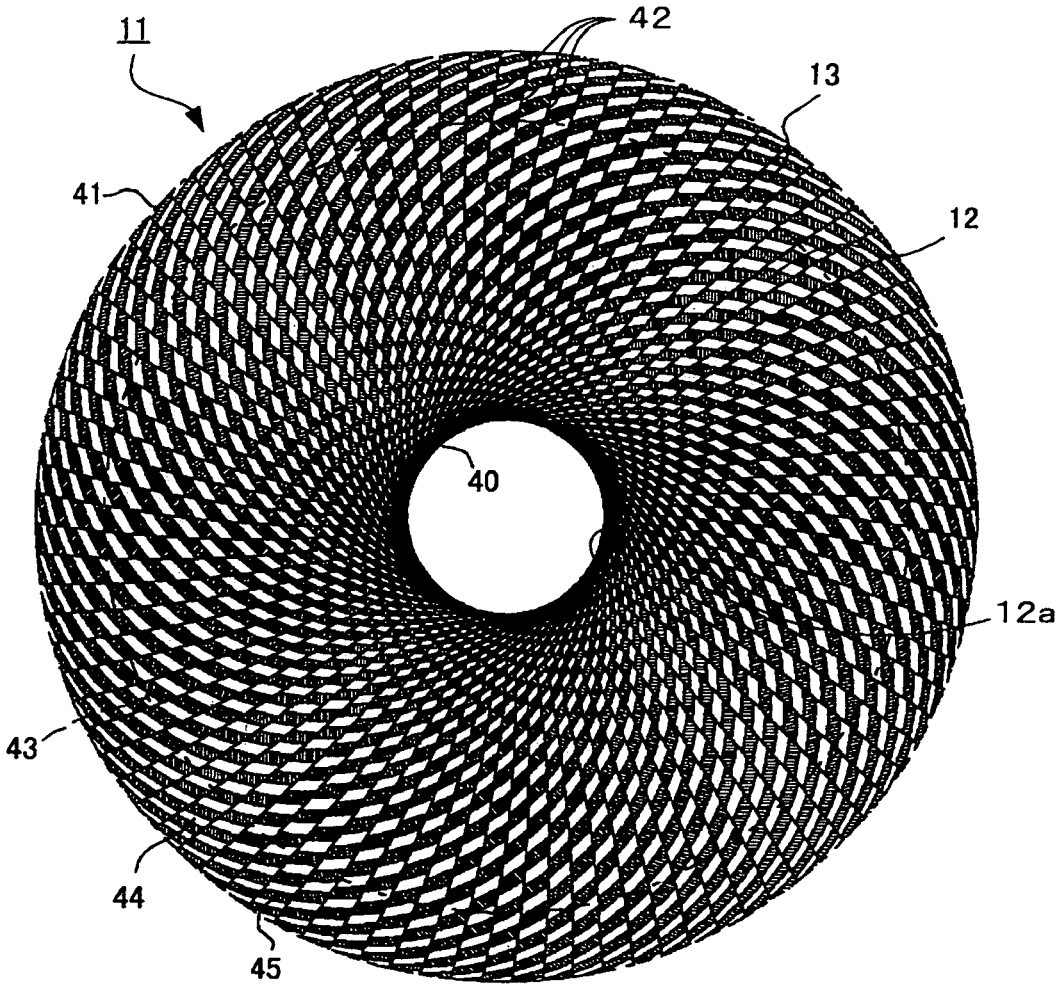
FIG. 2 is a front view of an embodiment of the speaker diaphragm according to the present invention.

Explained next with reference to FIG. 2 is the detailed configuration of the diaphragm 11 (FIG. 1) that is an embodiment of the speaker diaphragm according to the present invention.

As shown in FIG. 2, a plurality of concave sections 44 indicated by white color and convex sections 45 indicated by black color are formed on the surface of the diaphragm portion 12. The concave and convex sections 44 and 45 are formed over the entire surface of the diaphragm portion 12 between an inner periphery 40 (the edge of the opening 12*a*) and an outer periphery 41. A broken line 43 indicates the border between the diaphragm portion 12 and the edge 13 (FIG. 1).

The concave and convex sections 44 and 45 have a particular shape formed with four curved lines when viewed from above the diaphragm 11, which will be described later in detail. The convex sections 45 have a height of about 50 μm, for example.

As understood from FIG. 2, the concave and convex sections 44 and 45 are arranged in a specific pattern that is a unique feature of this embodiment, which will be described later in detail.

Figure 3:
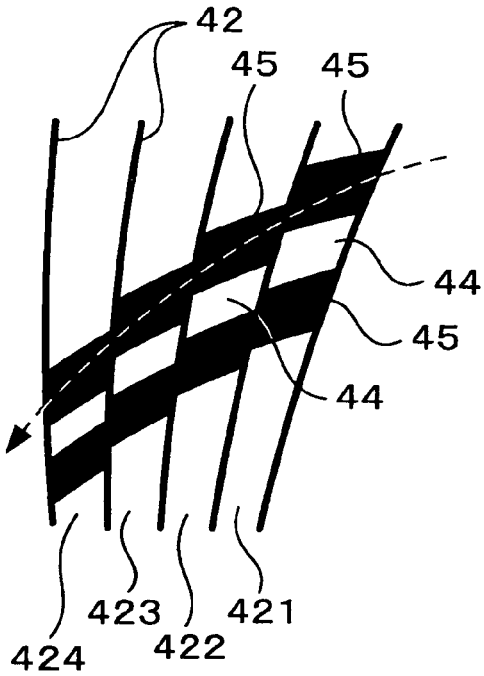
FIG. 3 is a partially enlarged front view of a diaphragm portion of the speaker diaphragm shown in FIG. 2.

FIG. 3 is a partially enlarged front view of the diaphragm portion 12 shown in FIG. 2, with some concave and convex sections 44 and 45.

As shown in FIGS. 2 and 3, a plurality of rib-like convex portions 42 are formed on the surface of the diaphragm portion 12. The rib-like convex portions 42 are formed in curved lines extending radially from the inner periphery 40 to the outer periphery 41 at a regular interval on the entire surface of the diaphragm portion 12. Each rib-like convex portion 42 is formed in a relatively gentle curved line in a radial direction.

Formed between adjacent two rib-like convex portions 42 are the two concave and convex sections 44 and 45 interposed between two imaginary curved lines that intersect with the rib-like convex portions 42.

In the partial enlarged view of FIG. 3, there are four regions 421, 422, 423, and 424 each located between adjacent two rib-like convex portions 42. The convex sections 45 in the region 421 are displaced from the convex sections 45 in the next region 422 in the radial direction but coupled partially. The same is true for the convex sections 45 in the regions 422 and 423, and also in the regions 423 and 424. Thus, a plurality of convex sections 45 are coupled to one another.

All of the concave and convex sections 44 and 45 are coupled to one another directly or indirectly over the enter surface of the diaphragm portion 12. In each pair of adjacent regions, such as the regions 421 and 422 in FIG. 3, two adjacent concave sections 44 are displaced from each other in the radial direction and separated from each other by the rib-like portion 42 provided therebetween.

In FIG. 3, suppose that the crossings, each being a point of intersection of four diagonals of an imaginary plane surface (when viewed from above the diaphragm portion 12) of each convex section 45, are connected one another for the convex sections 45 displaced from one another in the radial direction. The connection of crossings forms an imaginary curved line that goes over a plurality of regions, such as the regions 421 to 424, as indicated by a broken-line arrow.

Figure 4:
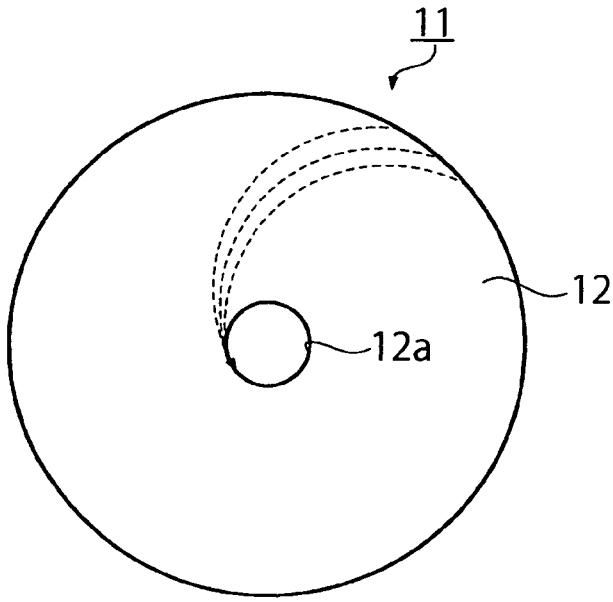
FIG. 4, is view schematically illustrating a pattern of concave and convex sections formed on the diaphragm portion shown in FIG. 3.

On the diaphragm 11 of this embodiment, as understood from FIG. 2, and also as schematically illustrated in FIG. 4, a plurality of convex sections 45 are aligned from the outer periphery 41 to the inner periphery 40, or vice versa, on a specific imaginary curved line.

Each specific imaginary curved line on which a plurality of convex sections 45 are aligned is like an asymptote that approaches the inner periphery 40 of the diaphragm portion 12. The same is true for the concave sections 44.

On the diaphragm 11 of this embodiment, as understood from FIG. 2, there are a plurality of imaginary lines like asymptotes on which a plurality of convex sections 45 are arranged over the enter surface of the diaphragm portion 12. The same is true for the concave sections 44.

The concave and convex sections 44 and 45 in each region, such as the region 421 (FIG. 3) interposed between two adjacent rib-like convex portions 42, become smaller from the outer periphery 41 towards the inner periphery 40 of the diaphragm portion 12 (FIG. 2).

The concave and convex sections 44 and 45 have a shape like a parallelogram but formed by four curved lines when viewed from above the diaphragm 11. The term "shape" is defined as a shape viewed from above the diaphragm 11, hereinafter.

The concave and convex sections 44 and 45 have a similar shape with each other. However, the term "a similar shape" may not necessarily be limited to that in mathematics but a similar shape in general.

In assembly of the diaphragm 11, it is difficult to form the concave and convex sections 44 and 45 smaller than a specific small size. In detail, in the vicinity of the inner periphery 40, the concave and convex sections 44 and 45 cannot be formed in a quadrilateral-like shape formed by four curved lines. They may have a shape like a triangle as being closer to the inner periphery 40.

The specific imaginary curved lines on each of which a plurality of concave sections 44 are aligned are like asymptotes that approach the inner periphery 40 of the diaphragm portion 12. The same is true for the specific imaginary curved lines on each of which a plurality of convex sections 45 are aligned. Actually, there are regions in which no concave and convex sections 44 and 45 exist in the vicinity of the inner periphery 40.

In the diaphragm 11 of this embodiment, the convex sections 45 formed on the circumference of each imaginary circle have the same size, but apart from one another, between the inner and outer peripheries 40 and 41 of the diaphragm portion 12. On the contrary, in each region such as the region 421 (FIG. 3) between two adjacent rib-like convex portions 42, all of the convex sections 45 have a different size from one another in the radial direction. Also all of the convex sections 45, over which each imaginary curved line (indicated by a broken-line arrow in FIG. 3) goes, have a different size from one another. These size requirements of the convex sections 45 are also applied to the concave sections 44.

The diaphragm 11 of this embodiment having the concave and convex sections 44 and 45 that are arranged in a unique pattern described above is capable of dispersing the resonance frequency, which will be discussed later in detail.

In the embodiment shown in FIG. 2, the concave and convex sections 44 and 45 are formed over the entire surface of the diaphragm portion 12 between the inner and outer peripheries 40 and 41. However, the concave and convex sections 44 and 45 that contribute to the dispersion of the resonance frequency are those formed within the border line 43 between the diaphragm portion 12 and the edge 13 (FIG. 1). Therefore, the concave and convex sections 44 and 45 formed on the edge 13 can be omitted. Not only that, the rib-like convex portions 42 (FIG. 3) extending from the inner periphery 40 to the outer periphery 41 in the radial direction can be omitted. Nevertheless, it is preferable to provide the rib-like convex portions 42.

The length of the concave section 44 having the maximum size among those on the diaphragm portion 12 is preferably ⅙ of or smaller than the distance from the antinode to node in a vibration mode. As shown in FIG. 3, each concave section 44 has a shape like a parallelogram having longer sides that cross the rib-like convex portions 42 and shorter sides than that extend along the rib-like convex portions 42. The longer sides of each concave section 44 are thus preferably set to ⅙ of or smaller than the distance from the antinode to node in a vibration mode.

The lengths of the sides of the concave section 44 having the maximum size determined according to the vibration mode give the number of the concave and convex sections 44 and 45 in the radial direction on the diaphragm portion 12 (FIG. 2). The number of the concave and convex sections 44 and 45 further gives the number of imaginary lines like asymptotes on each of which a plurality of concave and convex sections 44 and 45 are aligned.

The resonance frequency of the diaphragm 11 depends on the material of the diaphragm portion 12. The sizes of the concave and convex sections 44 and 45 are thus preferably determined in accordance with the material of the diaphragm portion 12.

Another preferable pattern of the concave and convex sections 44 and 45 is that a plurality of concave sections 44 (convex sections 45) are spirally aligned on the diaphragm portion 12 from the outer periphery 41 to the inner periphery 40 in FIG. 2.

In this pattern, a plurality of concave sections 44 are aligned on one imaginary line. A plurality of convex sections 45 are also aligned on another imaginary line. The concave and convex sections 44 and 45 are then formed on the two imaginary lines that are spirally drawn over the enter surface of the diaphragm portion 12.

As described above, there is at least one imaginary line with the concave sections 44 aligned thereon that approaches the inner periphery 40 of the diaphragm portion 12. The same is true for the convex sections 45.

Described next is an example of a method of producing the diaphragm 11 of this embodiment shown in FIG. 2.

The diaphragm 11 is made of plastic resin, for example. Concavities and convexities for forming the pattern of the concave and convex sections 44 and 45 shown in FIG. 2 is formed by etching on a mold to be used for producing the diaphragm 11. Before the pattern etching, a pattern corresponding to the pattern of the concave and convex sections 44 and 45 is formed on a film to be used for etching of the mold. In detail, a pattern of blacks and transparent sections corresponding to the convex sections 45 and the concave sections 44, respectively, is printed on a transparent film, thus a film to be used for etching of the mold being produced.

Figure 5:
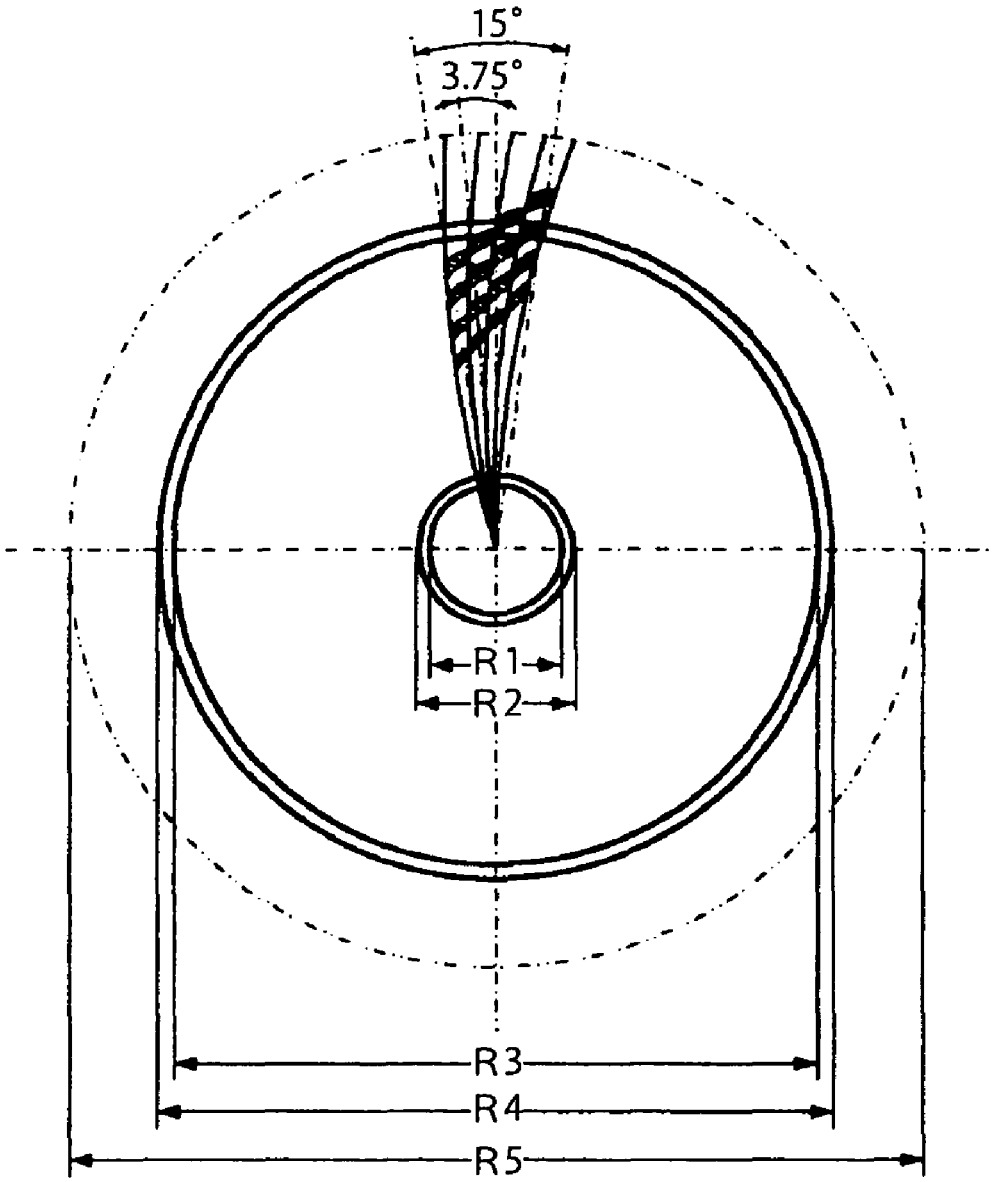
FIG. 5 is a view illustrating a method of forming a pattern of concave and convex sections.

Described with reference to FIG. 5 is an example of a method producing a block copy for use in forming a pattern of concavities and convexities corresponding to the concave and convex sections 44 and 45.

In FIG. 5, a diaphragm 11 to be produced is also shown for easier understanding the method of producing a block copy. Exemplary specifications of the diaphragm 11 to be produced and shown in FIG. 5 are that: 26.8 mm for the inner diameter R1 of the diaphragm portion 12; 30 mm for the inner diameter R2 of a pattern of concavities and convexities; 107 mm for the outer diameter R3 of the diaphragm portion 12; and 110 mm for the outermost diameter R4 of the diaphragm 11.

Firstly, a plurality of curved lines (five lines in the example of FIG. 5) are drawn from the starting center that corresponds to the center of the opening 12*a* of the diaphragm portion 12 towards the outer periphery 41 (FIG. 2). In detail, one gentle curved line is drawn first and is rotated by a specific angle, such as 3.75 degrees in FIG. 5, with respect to the center of the opening 12*a* step by step. Thus, five curved lines that extend in the radial direction are drawn, in this example.

In one specific region, such as the rightmost region in FIG. 5, interposed between two curved lines that extend in the radial direction, a pair of curved lines are drawn so that they cross the two curved lines to draw a shape (an original shape) formed by the four curved lines, that corresponds to a convex section 45. Each curved line in the pair may be part of a line like an asymptote that approaches the inner periphery 40 (FIG. 2) of the diaphragm portion 12. Or, a spiral line may be drawn so that it crosses the two curved lines to draw a shape (an original shape) formed by the two curved lines and the spiral line, that corresponds to a convex section 45. The original shape is drawn in black (indicted by hatched in FIG. 5.) The original shape may be provided in any location in each region interposed between two curved lines that extend in the radial direction.

The original shape is shifted in the specific region in the radial direction so that similar shapes formed by four curved lines are drawn having the size smaller towards the inner periphery 40 whereas larger towards the outer periphery 41 (FIG. 2). While these shapes are drawn, a transparent shape corresponding to a concave section 44 is formed between adjacent two shapes corresponding to convex sections 45.

As described above, a pattern of shapes corresponding to the concave and convex sections 44 and 45 is formed in the specific region.

In a region, the left side of the rightmost region (the specific region described above) in FIG. 5, the shapes corresponding to the concave and convex sections 44 and 45, and formed in the specific region are made smaller and shifted towards the inner periphery 40.

Accordingly, a pattern of shapes corresponding to the concave and convex sections 44 and 45 is formed in the region next to the specific region.

This procedure is repeated for the remaining regions so that patterns of shapes corresponding to the concave and convex sections 44 and 45 are formed in all of the four regions in the example shown in FIG. 5.

Shown in FIG. 5 is part of the patterns of shapes corresponding to the concave and convex sections 44 and 45.

The block copy has the outer diameter R5, for example, 143 mm, that is larger than the outermost diameter R4 of the diaphragm 11.

The patterns of shapes corresponding to the concave and convex sections 44 and 45 are formed in the area between the inner diameter R2 and the outer diameter R5.

In the example of FIG. 5, the four regions have an angle of 15 degrees between the leftmost and rightmost regions with respect to the center of the block copy. The four regions having the angle of 15 degrees are copied in the circumferential direction to form the patterns of shapes corresponding to the concave and convex sections 44 and 45 over the entire surface of the block copy, with 96 (360/3.75) regions in total.

The patterns of shapes corresponding to the concave and convex sections 44 and 45 formed on the block copy are then printed on a transparent film. A mold is etched with the transparent film having the patterns of shapes corresponding to the concave and convex sections 44 and 45 printed thereon. The mold having the patterns of shapes corresponding to the concave and convex sections 44 and 45 formed thereon is used for producing the diaphragm 11 shown in FIG. 2.

Figure 6:
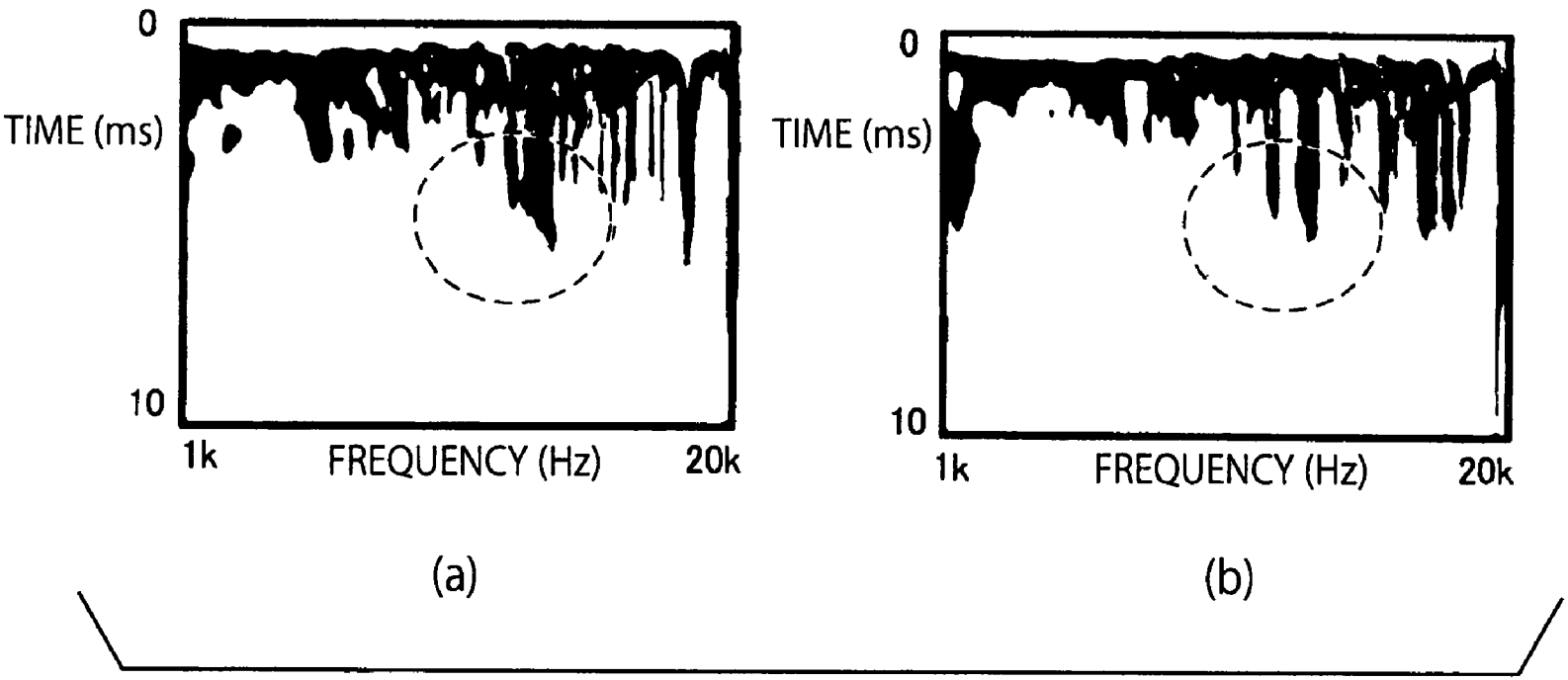
FIG. 6 is a view showing the attenuation characteristics of the speaker diaphragm according to the present invention and a known speaker diaphragm.

Discussed next with respect to FIG. 6 is the difference in reduction of incidental sounds between the diaphragm 11 of this embodiment and the known speaker diaphragm already described.

FIG. 6 shows the attenuation characteristics of the diaphragm 11 and the known diaphragm, indicating how the vibration level is lowered over a frequency range from 1 KHz to 20 KHz in accordance with the passage of time when a constant impulse is applied to both diaphragms.

Specifically, shown in (a) of FIG. 6 is the attenuation characteristics of the known diaphragm having concavities and convexities in a grid pattern, not such a unique pattern of concavities and convexities like the embodiment of the present invention. In contrast, shown in (b) of FIG. 6 is the attenuation characteristics of the diaphragm 11 having the concave and convex sections 44 and 45 arranged in the unique pattern of the embodiment of the present invention.

The attenuation characteristics of the diaphragms were measured by a Graphtec AT3200 laser doppler vibrometer.

As shown in circles indicated by a broken line, the vibration level of the diaphragm 11 of the embodiment was lowered quickly in a shorter period than that of the known diaphragm. This indicates that the resonance frequency of the diaphragm 11 was dispersed, thus decreasing incidental sounds.

As described above, in the diaphragm 11 of the embodiment, all of the concave and convex sections 44 and 45 have different sizes in the radial direction when viewed from above the diaphragm 11. The same is true for the concave sections 44 formed on each imaginary curved line and also the convex sections 45 formed on each imaginary curved line. The concave sections 44 formed on the circumference of each imaginary circle between the inner and outer peripheries 40 and 41 of the diaphragm portion 12 have the same size, but apart from one another. The same is also true for the convex sections 45

These requirements of the concave and convex sections 44 and 45 give different patterns of impedance change when surface waves propagate from the inner periphery 40 of the diaphragm portion 12 to the edge 13 formed therearound in FIG. 2, when the speaker 10 is driven to generate sounds. In other words, there is no same impedance-change pattern no mater what routes surface waves propagate from the inner periphery 40 to the edge 13 of the speaker 10.

The different impedance-change patterns of surface waves discussed above contribute to the dispersion of the resonance frequency of the diaphragm 11.

In the diaphragm 11 of the embodiment, the concave and convex sections 44 and 45 are arranged more tightly as these sections are closer to the inner periphery 40 of the diaphragm portion 12, as shown in FIG. 2. The vibration that adds unnecessary elements to sounds are thus converted into heat in the vicinity of the inner periphery 40. And, the heat is transferred to the inside of the diaphragm 11 and also the atmosphere.

Described next is a modification to the diaphragm 11 of the embodiment, having an oval shape.

An oval-shaped diaphragm preferably has different regions of a pattern of concavities and convexities, each region being located between two adjacent rib-like convex portions 42 (FIG. 3), between the major- and miner-axis areas in the circumferential direction.

In detail, in the case of the circular diaphragm 11 shown in FIG. 5, the regions 421, 422, 423, and 424 each located between two adjacent rib-like convex portions 42 have the constant angle of 3.75 degrees, for example. In contrast, the oval-shaped diaphragm preferably has such regions with a smaller angle in the major-axis area so that the concavities and convexities are tightly arranged whereas a bigger angle in the minor-axis area so that the concavities and convexities are loosely arranged.

It is further understood by those skilled in the art that the foregoing description is a preferred embodiment of the disclosed device and that various changes and modifications may be made in the invention without departing from the spirit and scope thereof.

For example, the concave and convex sections 44 and 45 may be formed on the rear or both surfaces of the diaphragm portion 12.

Moreover, the opening 12*a* (FIG. 2) may be displaced from the center of the of the diaphragm portion 12, or apart from the center at a specific distance.

As disclosed above in detail, the present invention achieves drastic reduction of incidental sounds by effectively dispersing the resonance frequency with an improved structure for a speaker diaphragm and a speaker equipped with such a speaker diaphragm.

What is claimed is:

1. A speaker diaphragm having a circular opening in a center zone thereof comprising:

a concave and convex pattern of a plurality of concave sections and convex sections formed on a front surface or a rear surface of the diaphragm;

wherein the concave and convex pattern is formed in a manner that;

a plurality of concave sections and convex sections are formed in each of a plurality of regions provided at a regular interval with a specific angle in a circumferential direction of the diaphragm, the concave and convex sections formed in each region have different sizes in a radial direction of the diaphragm, a plurality of concave and convex sections formed in adjacent regions are displaced from each other in the radial direction, and the concave sections and the convex sections formed on the diaphragm are aligned on at least a first imaginary curved line and at least a second imaginary curved line, respectively, each imaginary curved line passing a plurality of regions and approaching an inner periphery of the circular opening from an outer periphery of the diaphragm.

2. The speaker diaphragm according to claim 1, wherein the concave and convex sections formed in each region become smaller in size from the outer periphery towards the inner periphery.

3. The speaker diaphragm according to claim 1, wherein the concave and convex sections aligned on the first and second imaginary curved lines, respectively, become smaller in size from the outer periphery towards the inner periphery.

4. The speaker diaphragm according to claim 1 further comprising a plurality of protruding portions, each protruding portion extending as being curved in the circumferential direction, each region being interposed between two adjacent protruding portions, each concave section and each convex section having a shape formed by the two adjacent protruding portions and two imaginary curved lines that pass the two adjacent protruding portions.

5. The speaker diaphragm according to claim 4, wherein each convex section is coupled to the two adjacent protruding portions so that the convex sections aligned on the first imaginary curved line are partially displaced from but coupled to one another.

6. The speaker diaphragm according to claim 4, wherein, in each pair of two concave sections aligned in succession on the second imaginary curved line, the two concave sections are partially displaced from and separated from each another by the two adjacent protruding portions.

7. A speaker comprising:

a diaphragm having a circular opening in a center zone thereof; and a voice coil for vibrating the diaphragm in both directions of the front and rear surfaces in response to a current corresponding to an audio signal, wherein the diaphragm has a concave and convex pattern of a plurality of concave sections and convex sections formed on a front surface or a rear surface of the diaphragm, the concave and convex pattern being formed in a manner that;

a plurality of concave sections and convex sections are formed in each of a plurality of regions provided at a regular interval with a specific angle in a circumferential direction of the diaphragm, the concave and convex sections formed in each region have different sizes in a radial direction of the diaphragm, a plurality of concave and convex sections formed in adjacent regions are displaced from each other in the radial direction, and the concave sections and the convex sections formed on the diaphragm are aligned on at least a first imaginary curved line and at least a second imaginary curved line, respectively, each imaginary curved line passing a plurality of regions and approaching an inner periphery of the circular opening from an outer periphery of the diaphragm.

8. The speaker according to claim 7, wherein the concave and convex sections formed in each region become smaller in size from the outer periphery towards the inner periphery.

9. The speaker according to claim 7, wherein the concave and convex sections aligned on the first and second imaginary curved lines, respectively, become smaller in size from the outer periphery towards the inner periphery.

10. The speaker according to claim 7, wherein the diaphragm further having a plurality of protruding portions, each protruding portion extending as being curved in the circumferential direction, each region being interposed between two adjacent protruding portions, each concave section and each convex section having a shape formed by the two adjacent protruding portions and two imaginary curved lines that pass the two adjacent protruding portions.

11. The speaker according to claim 10, wherein each convex section is coupled to the two adjacent protruding portions so that the convex sections aligned on the first imaginary curved line are partially displaced from but coupled to one another.

12. The speaker according to claim 10, wherein, in each pair of two concave sections aligned in succession on the second imaginary curved line, the two concave sections are partially displaced from and separated from each another by the two adjacent protruding portions.

13. A speaker diaphragm comprising:

a front surface and a rear surface;

a circular opening provided in a center zone of the diaphragm and passing through the front and rear surfaces;

a pattern area that is wider than and covers the center zone, the pattern area being provided on at least either the front or the rear surface and being segmented into a plurality of regions at a regular interval with a specific angle in a circumferential direction with respect to the center zone, the regions being provided between an outer periphery of the pattern area and an inner periphery of the circular opening; and a pattern of concave sections and convex sections formed in the pattern area, wherein a plurality of concave sections and convex sections are formed alternately in each region of the pattern area, all of the concave and convex sections in each region having different sizes in a radial direction with respect to the center zone when viewed from above the diaphragm, a plurality of concave sections formed in a first region among the plurality of regions and a plurality of concave sections formed in a second region among the plurality of regions and next to the first region are partially displaced from each other in the radial direction, a plurality of convex sections formed in the first region and a plurality of convex sections formed in the second region are partially displaced from each other in the radial direction, and all of the concave sections and the convex sections of the pattern are aligned on at least a first imaginary curved line and a second imaginary curved line, respectively, each imaginary curved line passing the plurality of regions and approaching the inner periphery of the circular opening from the outer periphery of the pattern area.

14. A speaker comprising:

a diaphragm having a front surface and a rear surface, and a circular opening provided in a center zone of the diaphragm and passing through the front and rear surfaces; and a voice coil for vibrating the diaphragm in both directions of the front and rear surfaces in response to a current corresponding to an audio signal, wherein the diaphragm includes:

a pattern area that is wider than and covers the center zone, the pattern area being provided on at least either the front or the rear surface and being segmented into a plurality of regions at a regular interval with a specific angle in a circumferential direction with respect to the center zone, the regions being provided between an outer periphery of the pattern area and an inner periphery of the circular opening; and a pattern of concave sections and convex sections formed in the pattern area, wherein a plurality of concave sections and convex sections are formed alternately in each region of the pattern area, all of the concave and convex sections in each region having different sizes in a radial direction with respect to the center zone when viewed from above the diaphragm, a plurality of concave sections formed in a first region among the plurality of regions and a plurality of concave sections formed in a second region among the plurality of regions and next to the first region are partially displaced from each other in the radial direction, a plurality of convex sections formed in the first region and a plurality of convex sections formed in the second region are partially displaced from each other in the radial direction, and all of the concave sections and the convex sections of the pattern are aligned on at least a first imaginary curved line and a second imaginary curved line, respectively, each imaginary curved line passing the plurality of regions and approaching the inner periphery of the circular opening from the outer periphery of the pattern area.

* * * * *